US010017979B2

(12) United States Patent
Ando et al.

(10) Patent No.: US 10,017,979 B2
(45) Date of Patent: Jul. 10, 2018

(54) WINDOW REGULATOR AND METHOD OF PRODUCING WINDOW REGULATOR

(71) Applicant: SHIROKI CORPORATION, Kanagawa (JP)

(72) Inventors: Osamu Ando, Kanagawa (JP); Kohei Waki, Kanagawa (JP); Kimihiro Kinoshita, Kanagawa (JP)

(73) Assignee: SHIROKI CORPORATION, Kanagawa (JP)

( * ) Notice: Subject to any disclaimer, the term of this patent is extended or adjusted under 35 U.S.C. 154(b) by 265 days.

(21) Appl. No.: 15/105,937

(22) PCT Filed: Dec. 2, 2014

(86) PCT No.: PCT/JP2014/081874
§ 371 (c)(1),
(2) Date: Jun. 17, 2016

(87) PCT Pub. No.: WO2015/093285
PCT Pub. Date: Jun. 25, 2015

(65) Prior Publication Data

US 2017/0030130 A1 Feb. 2, 2017

(30) Foreign Application Priority Data

Dec. 17, 2013 (JP) ..... 2013-260156

(51) Int. Cl.
*E05F 11/48* (2006.01)
*E05F 15/689* (2015.01)
(Continued)

(52) U.S. Cl.
CPC ..... *E05F 15/689* (2015.01); *E05D 15/165* (2013.01); *E05F 11/385* (2013.01);
(Continued)

(58) Field of Classification Search
CPC ..... E05F 11/483; E05F 15/689; E05F 11/385; E05F 11/486; E05F 11/485; E05F 15/697;
(Continued)

(56) References Cited

U.S. PATENT DOCUMENTS 4,663,886 A * 5/1987 Nakamura ..... B60J 1/17 49/352
6,115,966 A * 9/2000 Shibata ..... E05F 11/481 296/146.2

(Continued)

FOREIGN PATENT DOCUMENTS

JP 2011231551 A 11/2011
JP 2013245446 A 12/2013

OTHER PUBLICATIONS

International Search Report for PCT/JP2014/081874 dated Jan. 27, 2015.

(Continued)

*Primary Examiner* — Chi Q Nguyen
(74) *Attorney, Agent, or Firm* — Millen, White, Zelano & Branigan, P.C.; William Nixon

(57) ABSTRACT

In a window regulator, and a method of producing the same, which moves a slider base along a guide rail via wires in accordance with rotation of a drum, includes a fitting portion having a first protrusion and a second protrusion provided on a drum housing which supports the drum, wherein the first protrusion protrudes from an abutting surface of the drum housing with which an end surface of the guide rail can come into contact and wherein the second protrusion protrudes from the abutting surface by a smaller amount of protrusion than that of the first protrusion, and the drum housing and the guide rail are joined by restricting movement of the guide rail in the thickness direction thereof by inserting the guide rail in between the first protrusion and the
(Continued)

second protrusion. Workability during manufacturing of the window regulator is thereby improved.

9 Claims, 15 Drawing Sheets

(51) Int. Cl.
*E05D 15/16* (2006.01)
*E05F 11/38* (2006.01)
*E05F 15/697* (2015.01)

(52) U.S. Cl.
CPC ..... *E05F 11/483* (2013.01); *E05F 11/486* (2013.01); *E05F 15/697* (2015.01); *E05Y 2201/654* (2013.01); *E05Y 2201/664* (2013.01); *E05Y 2201/684* (2013.01); *E05Y 2900/55* (2013.01)

(58) Field of Classification Search
CPC .... E05F 11/382; E05F 11/488; E05D 15/165; E05Y 2201/664; E05Y 2201/684; E05Y 2201/654; E05Y 2900/55; E05Y 2201/668; E05Y 2201/652
USPC ..... 49/360, 324, 332, 352, 248, 275, 349, 49/350, 351, 361, 362, 363
See application file for complete search history.

(56) References Cited

U.S. PATENT DOCUMENTS

| | | | | |
|---|---|---|---|---|
| 9,163,448 | B2 * | 10/2015 | Imaoka | E05F 11/486 |
| 9,227,485 | B2 * | 1/2016 | Baba | E05F 11/486 |
| 9,255,433 | B2 * | 2/2016 | Imaoka | E05F 11/486 |
| 9,580,953 | B1 * | 2/2017 | Matsushita | E05F 15/689 |
| 9,822,568 | B2 * | 11/2017 | Matsushita | E05D 15/165 |
| 2003/0066244 | A1 * | 4/2003 | Staser | E05F 11/385 49/375 |
| 2013/0227889 | A1 * | 9/2013 | Matsushita | E05F 11/483 49/352 |
| 2014/0007507 | A1 * | 1/2014 | Umemura | E05F 11/481 49/349 |
| 2014/0109481 | A1 * | 4/2014 | Umemura | E05F 11/483 49/352 |
| 2015/0101252 | A1 * | 4/2015 | Baba | E05F 11/486 49/349 |
| 2017/0268273 | A1 * | 9/2017 | Matsushita | E05D 15/165 |

OTHER PUBLICATIONS

English Abstract for JP2011231551, Publication Date: Nov. 17, 2011.
English Abstract of JP2013245446, Publication Date: Dec. 9, 2013.

* cited by examiner

WINDOW REGULATOR AND METHOD OF PRODUCING WINDOW REGULATOR

TECHNICAL FIELD

The present invention relates to a wire-type window regulator and a method of producing the same.

BACKGROUND ART

In a wire-type window regulator that drives a window glass up and down by pulling the window glass using wires (cables), the wires are tensioned when the regulator is in a completed state. Therefore, it is difficult, in terms of execution, to route the wires onto the regulator with the remaining components disposed in their completed state.

Patent Literature 1 has been proposed to attempt an improvement in productivity of a window regulator in which a carrier plate that holds a window glass is supported on a guide rail in a manner to allow the carrier plate to move relative to the guide rail in the lengthwise direction thereof, in which the guide rail is provided at one and the other end thereof with a wire guide and a drum, respectively, and in which the window regulator includes a raising wire which is wound around the wire guide to connect the drum and the carrier plate, and a lowering wire which connects the drum and the carrier plate without being wound around the wire guide. The drum housing that houses the drum is provided with a guide rail housing portion which allows the guide rail to move in the lengthwise direction thereof and restricts movement of the guide rail in directions orthogonal to the lengthwise direction of the guide rail; when installing the raising wire and the lowering wire, the relative position between the guide rail and the drum housing is determined so that the distance between the wire guide and the drum in the lengthwise direction of the guide rail becomes small, and the distance between the wire guide and the drum is increased to move each wire to a tensioned state by changing the relative position between the guide rail and the drum housing in the lengthwise direction of the guide rail after the installation of each wire. In this state, a restriction portion is formed by bending (cutting and raising) portions of the guide rail into lugs, and the relative movement between the guide rail and the housing in a direction to reduce the distance between the wire guide and the drum (a direction to loosen the wire tension) is restricted by engaging the restriction portion with an end of the drum housing.

CITATION LIST

Patent Literature

Patent Literature 1: Japanese Unexamined Patent Publication No. 2011-231551

SUMMARY OF INVENTION

Technical Problem

In the window regulator disclosed in Patent Literature 1, the procedure for forming the restriction portion, which is formed by bending portions of the guide rail to be engaged with the housing, is additionally required when an end of the guide rail is fitted to the guide rail housing portion of the drum housing, which complicates the assembling operation.

An object of the present invention is to provide a window regulator and a method of producing a window regulator that are superior in workability during manufacturing.

Solution to Problem

In embodiment, a method of producing a window regulator for raising and lowering a window glass of a vehicle is provided, the window regulator including a guide rail which extends in raising and lowering directions of the window glass, a slider base which supports the window glass and is slidably supported relative to the guide rail in a lengthwise direction thereof, a drum housing which supports a drum in a manner to allow the drum to rotate and includes an abutting surface with which an end surface of the guide rail is in contact, and a wire which connects the drum and the slider base and moves the slider base along the guide rail in accordance with rotation of the drum. The method includes providing the drum housing, on the abutting surface thereof, with a fitting portion which includes a first protrusion and a second protrusion, the second protrusion protruding from the abutting surface by a smaller amount than that of the first protrusion and facing the first protrusion while being spaced from the first protrusion in a thickness direction of the guide rail; connecting the wire to the slider base and the drum which are respectively supported by the guide rail and the drum housing in a state where the wire is loosened and in a state where the guide rail and the fitting portion of the drum housing are not engaged with each other; moving the guide rail and the drum housing relative to each other in a direction to increase tension of the wire along the lengthwise direction of the guide rail; moving the guide rail and the drum housing relative to each other in the thickness direction of the guide rail to allow an end of the guide rail ride over the second protrusion; and inserting the guide rail in between the first protrusion and the second protrusion to restrict movement of the guide rail in the thickness direction of the guide rail in a state where the wire is tensioned.

In the method of producing the window regulator, a pair of the second protrusions are spaced from each other in a widthwise direction of the guide rail, the fitting portion includes a central protrusion which is positioned between the pair of second protrusions, the central protrusion protruding from the abutting surface by a greater amount than that of the pair of second protrusions, and the guide rail includes a fitting groove which is fitted on the central protrusion.

It is desirable for a lower end surface of the drum housing to abut against the abutting surface of the drum housing.

In an embodiment, a method of producing a window regulator for raising and lowering a window glass of a vehicle is provided, the window regulator including a guide rail which extends in raising and lowering directions of the window glass, a slider base which supports the window glass and is slidably supported relative to the guide rail in a lengthwise direction thereof, a drum housing which supports a drum in a manner to allow the drum to rotate and includes an abutting surface with which an end surface of the guide rail is in contact, and a wire which connects the drum and the slider base and moves the slider base along the guide rail in accordance with rotation of the drum. The method includes providing the drum housing, on the abutting surface thereof, with a fitting portion which includes a first protrusion and a second protrusion, the second protrusion protruding from the abutting surface by a smaller amount than that of the first protrusion and facing the first protrusion while being spaced from the first protrusion in a thickness direction of the guide rail; connecting the wire to the slider base and the drum which are respectively supported by the guide rail and the drum housing in a state where the wire is loosened and in a state where the guide rail and the fitting portion of the drum housing are not engaged with each other; abutting the end surface of the guide rail against the fitting portion of the drum housing in a different orientation from an orientation in a completed state of the window regulator, and increasing tension of the wire while changing an angle of the guide rail with the abutting portion, on which the end surface of the guide rail abuts against the fitting portion, as a fulcrum; and positioning the guide rail between the first protrusion and the second protrusion to restrict movement of the guide rail in the thickness direction of the guide rail in a state where the wire is tensioned.

It is desirable for the first protrusion to include a body portion which protrudes from the abutting surface by a greater amount than that of the second protrusion, and a stepped portion which is positioned between the body portion and the second protrusion, the stepped portion protruding from the abutting surface by a smaller amount than that of the body portion. The end surface of the guide rail abuts against the stepped portion, and the angle of the guide rail is changed, with the abutting portion as a fulcrum.

In an embodiment, a window regulator for raising and lowering a window glass of a vehicle is provide, including a guide rail which extends in raising and lowering directions of the window glass; a slider base configured to support the window glass and is supported by the guide rail to slide relative to the guide rail in a lengthwise direction thereof; a drum housing configured to support a drum in a manner to allow the drum to rotate, the drum housing including a fitting portion that is fitted to one end of the guide rail; a wire guide which is supported by another end of the guide rail; and a wire which is guided by the wire guide and connects the drum with the slider base, the wire moving the slider base along the guide rail in accordance with a rotation of the drum. The fitting portion of the drum housing includes a first protrusion configured to protrude from an abutting surface with which an end surface of the guide rail is in contact; a pair of second protrusions which protrude from the abutting surface, protrude from the abutting surface by a smaller amount than that of the first protrusion, restrict movement of the guide rail in a thickness direction thereof by inserting the guide rail in between the first protrusion and the pair of second protrusions, and are provided spaced from each other in a widthwise direction of the guide rail; and a central protrusion which is formed integral with the first protrusion, is positioned between the pair of second protrusions and greater in amount of protrusion from the abutting surface than the pair of second protrusions. The guide rail includes a fitting groove which is fitted on the central protrusion.

It is desirable for the first protrusion to include a body portion which protrudes from the abutting surface by a greater amount than that of the second protrusion, and a stepped portion which is positioned between the body portion and the second protrusion, the stepped portion protruding from the abutting surface by a smaller amount than that of the body portion.

It is desirable for the drum housing to include a wire insertion slit which allows the wire to be inserted thereinto, and a slit portion which is formed on a side surface adjacent to the abutting surface to be continuous with the wire insertion slit.

It is desirable for the central protrusion to be smaller in width than the first protrusion.

Advantageous Effects of Invention

According to the window regulator and the method of producing the window regulator of the present invention, since the fitting portion of the drum housing is provided with the first protrusion and the second protrusion, which are mutually different in amount of protrusion from the abutting surface of the drum housing, and also since the fit-engaged state between the drum housing and the guide rail is achieved by inserting the guide rail in between the first protrusion and the second protrusion and restricting movement of the guide rail with respect to the drum housing in the thickness direction of the guide rail, the assembling operation for the drum housing and the guide rail can be easily performed, which improves the workability during manufacturing of the window regulator.

DESCRIPTION OF EMBODIMENTS

Figure 1:
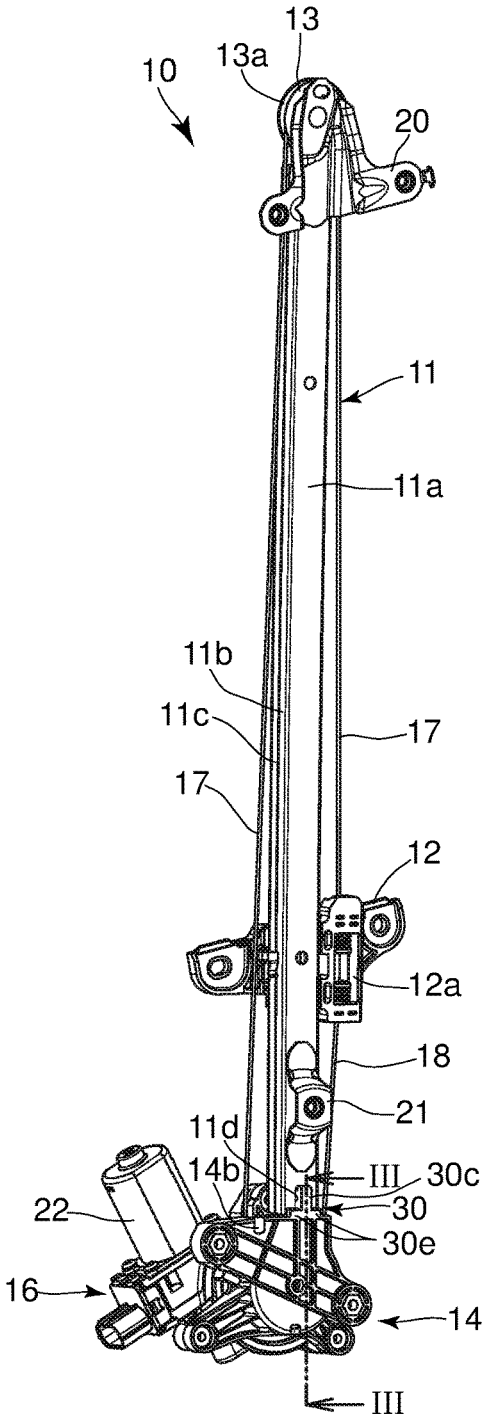
FIG. 1 is a perspective view of a first embodiment of a window regulator to which the present invention has been applied.

The window regulator 10 shown in FIG. 1 is provided with a guide rail 11, a slide base 12 which is supported to be movable in the lengthwise direction of the guide rail 11, a wire guide 13 which is supported by a portion of the guide rail 11 in the vicinity of one end thereof in the lengthwise direction of the guide rail 11, a drum housing 14 which is connected to the other end of the guide rail 11 in the lengthwise direction thereof, a drum 15 (FIGS. 2 and 3) which is rotatably supported inside the drum housing 14, a driver 16 which rotationally drives the drum 15, and a first wire 17 and a second wire 18 which apply pulling forces to the slider base 12 in forward and reverse directions.

The guide rail 11 is a long member which is formed of a plate-like material made of metal or the like, forms a U-shaped cross section via a central plate portion 11*a* and a pair of side plate portions 11*b* that are formed on both sides of the central plate portion 11*a*, and is provided with a pair of flanges 11*c* which project laterally from the pair of side plate portions 11*b*. Brackets 20 and 21 are fixed to the guide rail 11, and the window regulator 10 in a completed state is fixed, via the brackets 20 and 21, to an inner panel (not shown) which constitutes a vehicle door. At this stage, the guide rail 11 is installed with the lengthwise direction thereof extending in the upward/downward direction (vertical direction) of the window glass, and the end of the guide rail 11 that supports the wire guide 13 faces upwardly and the end of the guide rail 11 that is connected to the drum housing 14 faces downwardly. Correspondingly, the end of the guide rail 11 that supports the wire guide 13 and the end of the guide rail 11 that is connected to the drum housing 14 are referred to as the upper end and the lower end, respectively. Additionally, the widthwise direction of the central plate portions 11*a* (the direction which connects the pair of side plate portions 11*b* with the shortest distance) is referred to as the widthwise direction of the guide rail 11, and the thickness direction of the central plate portion 11*a* is referred to as the thickness direction of the guide rail 11. The guide rail 11 is provided, at the center of the lower end of the central plate portion 11*a* in the widthwise direction of the guide rail 11, with a fitting groove 11*d*, which is formed by cutting out a portion of the central plate portion 11*a* along the lengthwise direction of the guide rail 11. The fitting groove 11*d* is an elongated groove which is open at the lower end of guide rail 11.

The slider base 12 supports a window glass (not shown in the drawings) and is engaged with the flanges 11*c* of the guide rail 11 to be slidable in the lengthwise direction of the guide rail 11. The wire guide 13 is supported to be rotatable with respect to a support shaft 25 (FIG. 2) provided on the guide rail 11 in the vicinity of the upper end thereof, and is provided on the outer periphery of the wire guide 13 with a guide groove 13*a*. It is also possible to provide the wire guide 13 as a member which is secured to the guide rail 11, not as a rotatable member.

Figure 2:
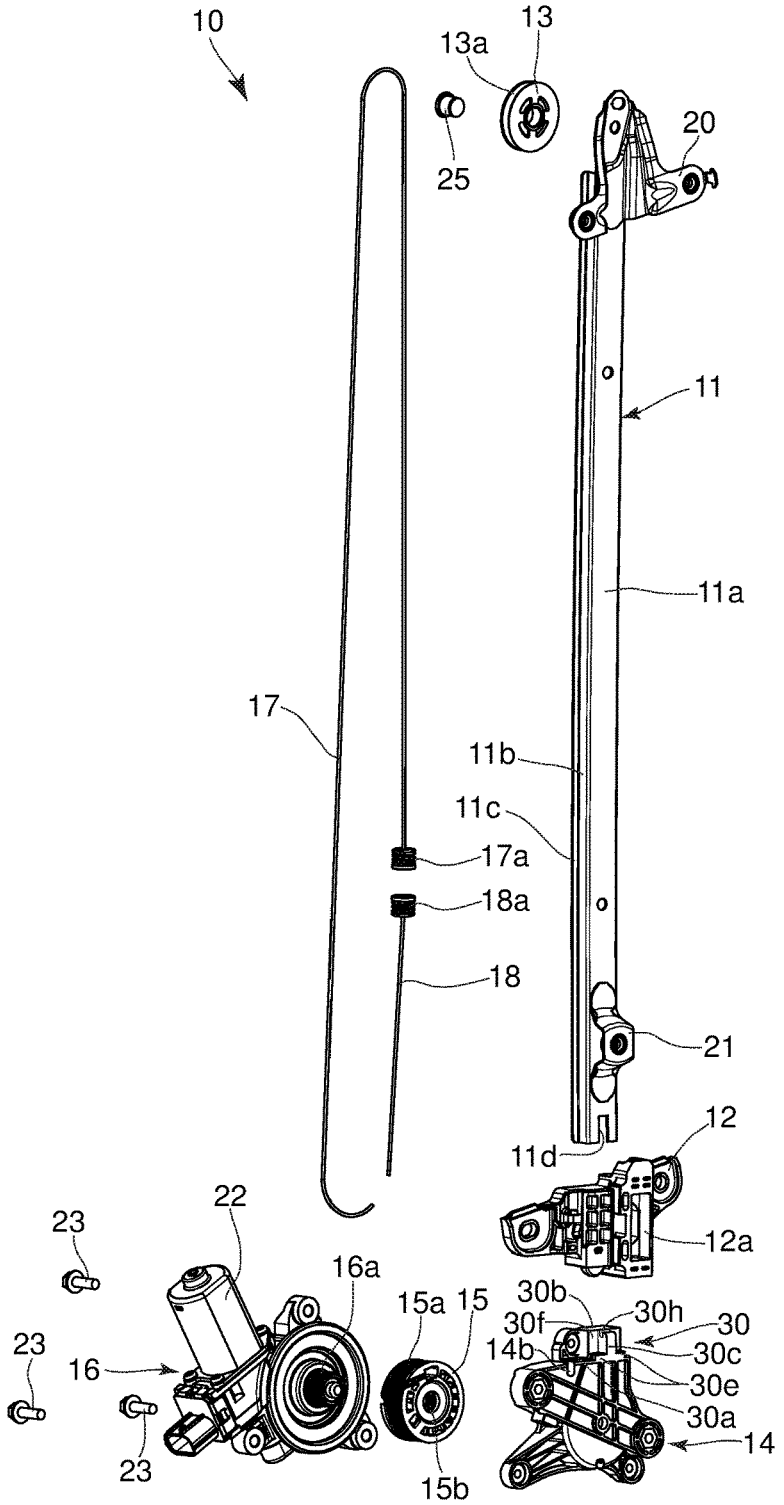
FIG. 2 is an exploded perspective view of the window regulator.
Figure 3:
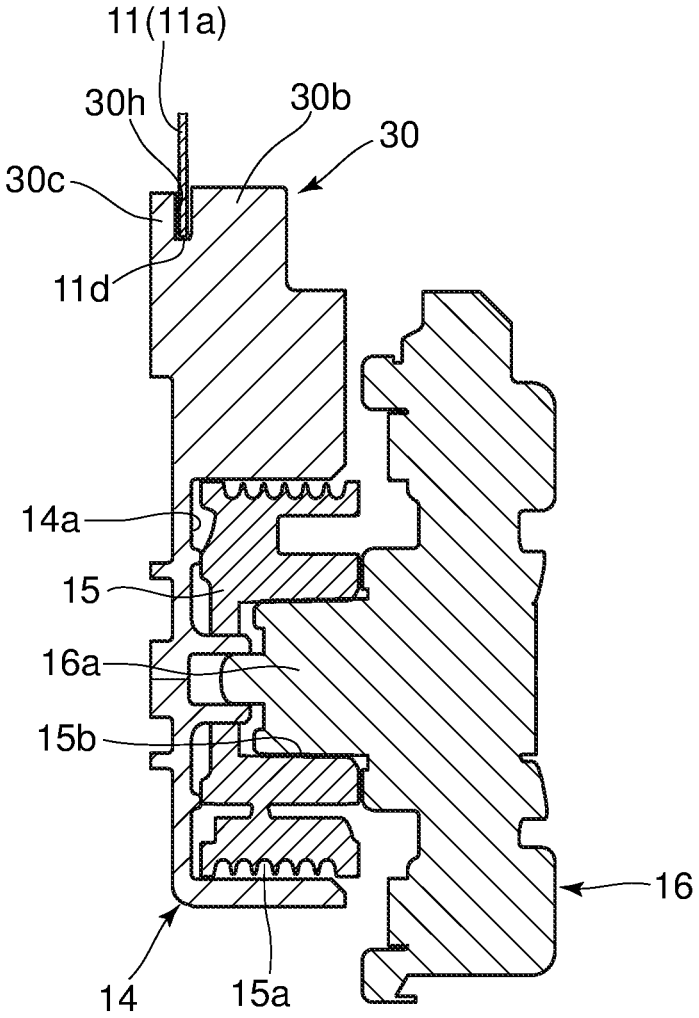
FIG. 3 is a sectional view taken along the line shown in FIG. 1.

As shown in FIG. 3, the drum 15 is rotatably supported inside a recessed portion 14*a* formed in the drum housing 14. The drum housing 14 is provided with a wire insertion slit 14*b* (FIGS. 1, 2, 4 and 5) which is communicatively connected to an outer surface of the drum housing 14 from the recessed portion 14*a*. The wire insertion slit 14*b* is configured of an upper-surface slit portion which is open to an upper surface of the drum housing 14 (to an abutting surface 30*a* side of a fitting portion 30 which will be discussed later) and a side-surface slit portion which is open to a side surface of the drum housing 14 (specifically the side surface thereof seen in FIGS. 4 and 5) that is adjacent to the aforementioned upper surface; these slit portions are continuous with each other, and the first wire 17 is inserted into the wire insertion slit 14*b*. Although not shown in the drawings, a wire insertion slit into which the second wire 18 is inserted is formed in the drum hosing 14. This insertion slit is open at a side surface of the drum housing 14 which is not seen in FIGS. 1, 2, 4 and 5. A wire winding groove 15*a*, in the shape of a spiral, is formed on the outer periphery of the drum 15. A drive shaft 16*a* provided on the driver 16 is fitted into a rotation transmission hole 15*b* formed in the center of the drum 15, so that the drum 15 can be rotated forward and reverse by rotating the drive shaft 16*a* with the drive force of a motor 22 provided on the driver 16. The driver 16 is fixed to the drum housing 14 with set screws 23 (FIG. 2).

The first wire 17, specifically an intermediate portion thereof, is wound on the guide groove 13*a* of the wire guide 13, and an end of one of the pair of portions of the first wire 17 that extends downward along the guide rail 11 from the wire guide 13 is connected to the drum 15. The first wire 17 is provided at the other end thereof with an end portion 17*a* having a structure including an end cap and a coil spring fixed to the end cap, and the end portion 17*a* is connected to a wire connecting portion 12*a* of the slider base 12. The second wire 18 is connected at one end thereof to the drum 15 and provided at the other end with an end portion 18*a*, which is identical in structure to the end portion 17*a* of the first wire 17. The end portion 18*a* of the second wire 18 is connected to the wire connecting portion 12*a* of the slider base 12 from the opposite side thereof from the end portion 17*a* of the first wire 17. (i.e., from the lower side). With the first wire 17 and the second wire 18 connected to the drum 15 and the slider base 12 in such a manner, a tensile force is applied to each of the first wire 17 and the second wire 18, and this tensile force acts along the lengthwise direction of the guide rail 11, in which each of the first wire 17 and the second wire 18 is extended. The first wire 17 and the second wire 18 are inserted into the recessed portion 14*a* of the drum housing 14 through the wire insertion slit 14*b* and the aforementioned wire insertion slit (not shown in the drawings), respectively, and the amount of winding of each wire onto the wire winding groove 15*a* varies in accordance with the rotation of the drum 15 in the recessed portion 14*a*. Rotating the drum 15 in a direction to increase the amount of winding the first wire 17 onto the wire winding groove 15*a* causes the slider base 12 to be pulled by the first wire 17, thus causing the slider base 12 to move in a direction to approach the wire guide 13 (in the upward direction). On the other hand, rotating the drum 15 in the direction to increase the amount of winding the second wire 18 onto the wire winding groove 15*a* causes the slider base 12 to be pulled by the second wire 18, thus causing the slider base 12 to move in a direction to approach the drum housing 14 (in the downward direction).

Figure 4:
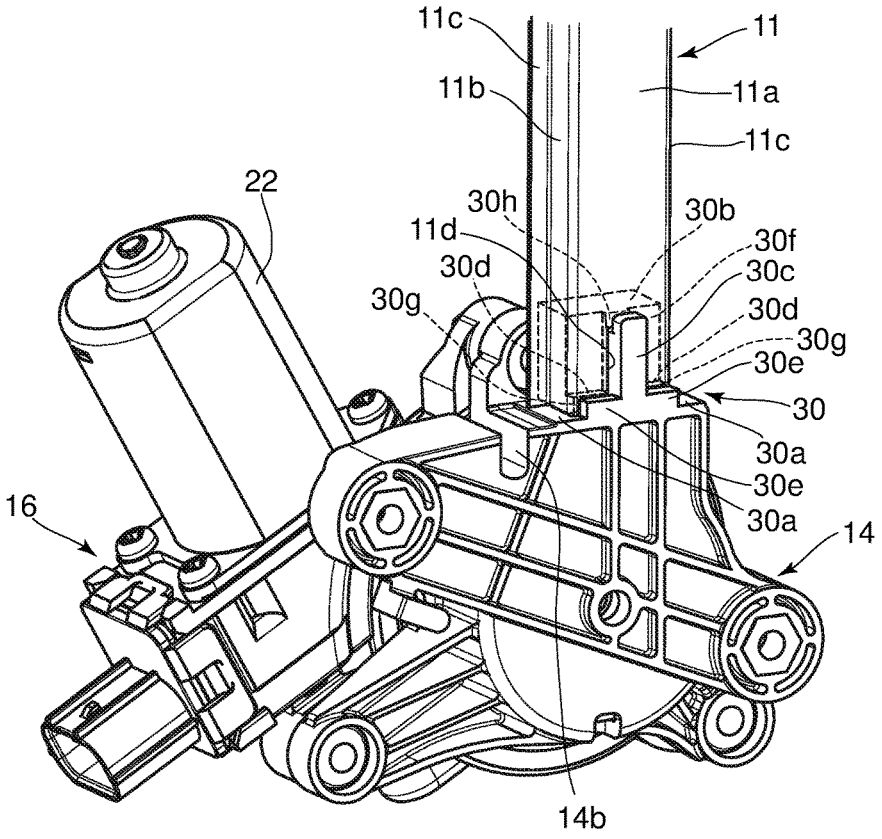
FIG. 4 is a perspective view illustrating the joined portion between a drum housing and a guide rail.
Figure 5:
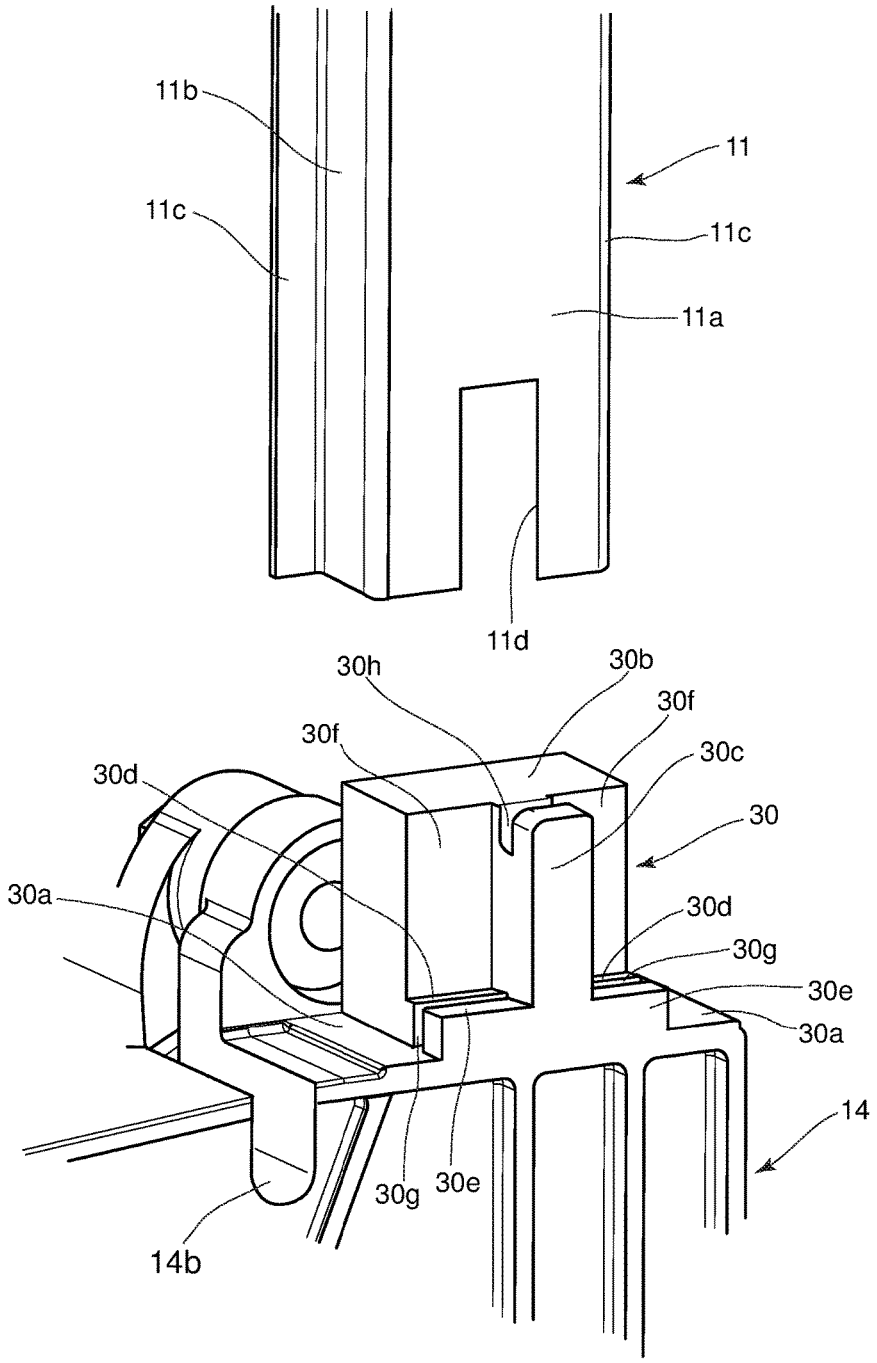
FIG. 5 is an exploded perspective view illustrating a portion of the drum housing in the vicinity of the fitting portion thereof and a portion of the guide rail in the vicinity of the lower end thereof.
Figure 6:
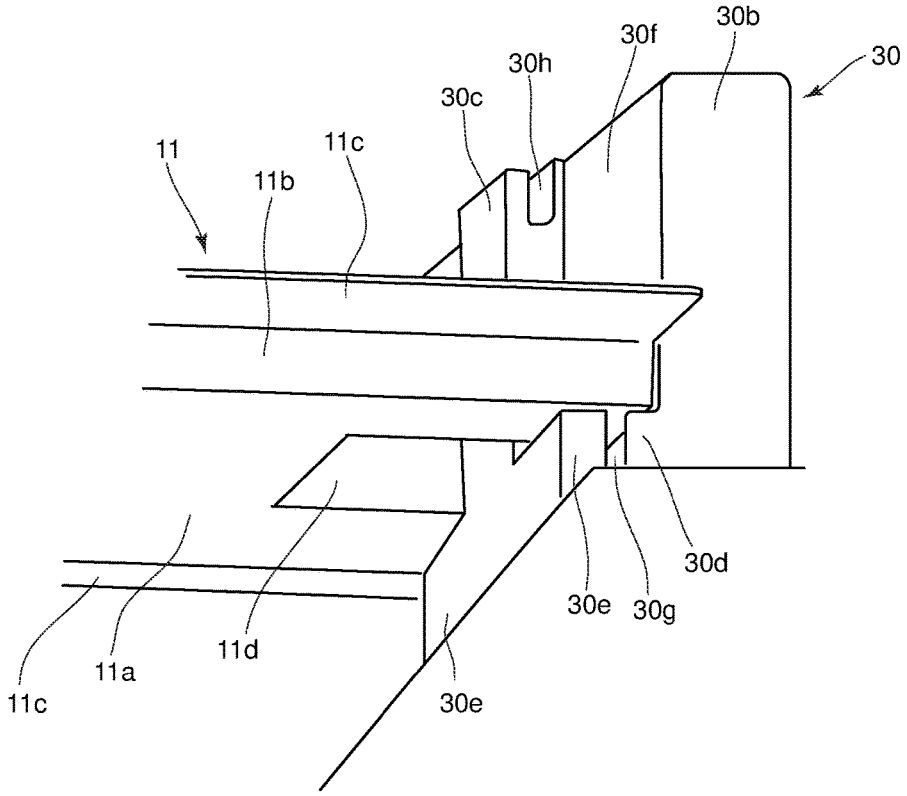
FIG. 6 is a perspective view of the joined portion between the drum housing and the guide rail, illustrating a state where the drum housing and the guide rail are in the process of being joined to each other in the first embodiment.

The drum housing 14 is provided with the fitting portion 30, which allows the lower end of the guide rail 11 to be fitted thereon. As shown in FIGS. 4 through 6, the fitting portion 30 is provided, on an abutting surface 30*a* thereof which faces upward, with an angular protrusion (first protrusion/body portion) 30*b*, a central retaining protrusion (central protrusion) 30*c*, fulcrum protrusions (first protrusion/stepped portion) 30*d*, and bilaterally-positioned protrusions (second protrusions) 30*e*. The angular protrusion 30*b* has a width allowing the angular protrusion 30*b* to be held between the pair of side plate portions 11*b* of the guide rail 11, so that engagement between both sides of the angular protrusion 30*b* and the pair of side plate portions 11*b*, respectively, restrict the movement of the guide rail 11 in the widthwise direction of the guide rail 11. The angular protrusion 30*b* is further provided with a restriction surface 30*f* which faces the central plate portion 11*a* of the guide rail 11. The central retaining protrusion 30*c* is smaller in width than the angular protrusion 30*b* and protrudes in a direction orthogonal to the restriction surface 30*f* of the angular protrusion 30*b* from an approximate center of the restriction surface 30*f* in the widthwise direction thereof. The fulcrum protrusions 30*d* are provided as a pair formed on both sides of the central retaining protrusion 30*c*, and the bilaterally-positioned protrusions 30*e* are provided as a pair formed on both sides of the central retaining protrusion 30*c*. The fulcrum protrusions 30*d* and the bilaterally-positioned protrusions 30*e* each protrude (in height) by a smaller amount from the abutting surface 30*a* than the central retaining protrusion 30*c*. Each fulcrum protrusion 30*d* and the associated (adjacent) bilaterally-positioned protrusion 30*e* are spaced from each other with a fitting groove 30*g* provided therebetween, and the fulcrum protrusions 30*d* are positioned closer to the angular protrusion 30*b* than the bilaterally-positioned protrusions 30*e* (positioned adjacent to the restriction surface 30*f*). In addition, a fitting groove 30*h* is formed between the upper part of the angular protrusion 30*b* and the upper part of the central retaining protrusion 30*c*.

Figure 10:
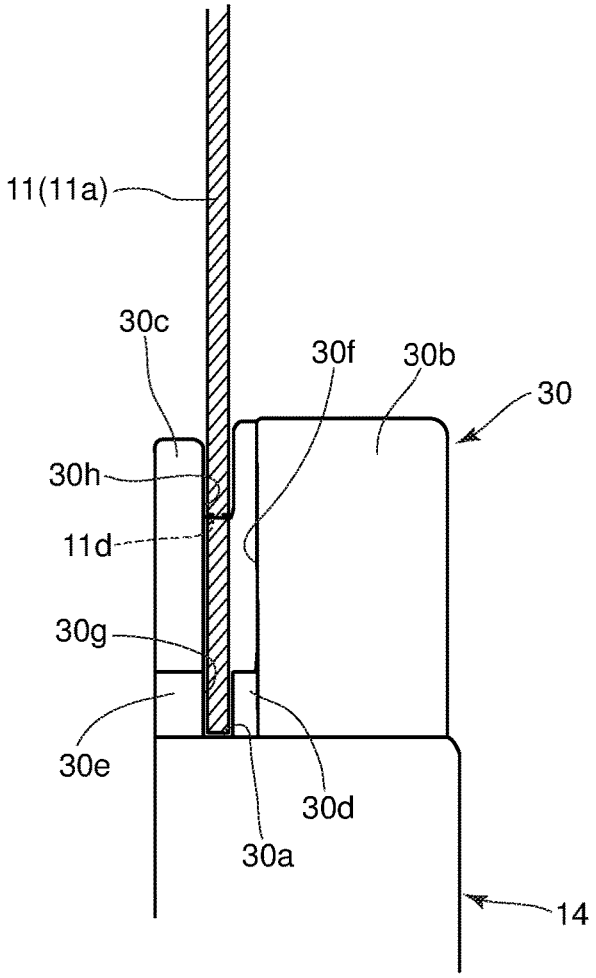
FIG. 10 is a side elevational view illustrating a stage at which the fitting of the guide rail onto the drum housing has been completed.
Figure 11:
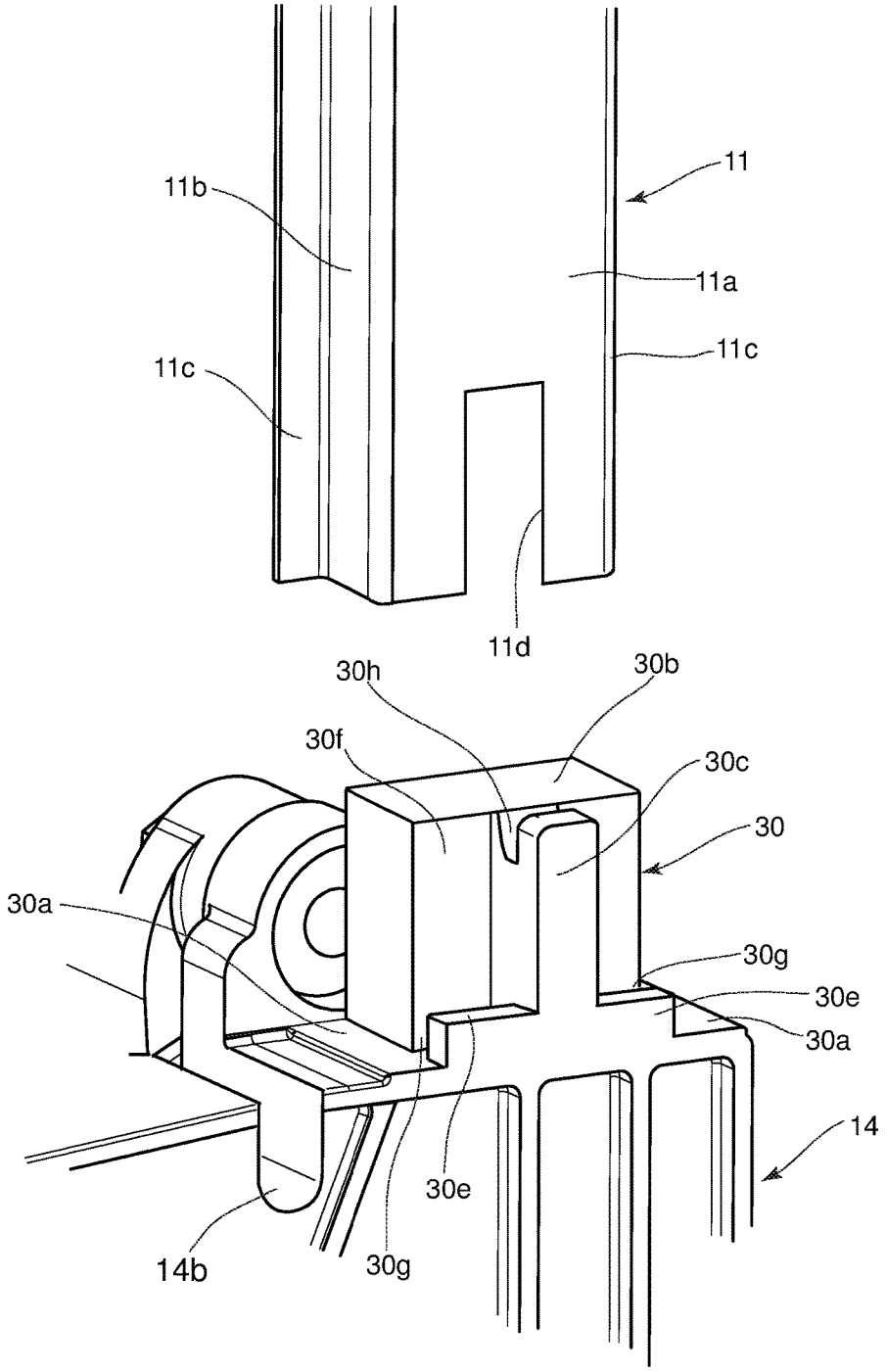
FIG. 11 is an exploded perspective view illustrating a portion of the drum housing in the vicinity of the fitting portion thereof and a portion of the guide rail in the vicinity of the lower end thereof in a second embodiment.

Each of the fitting grooves 30*g* and 30*h* has a groove width that allows the central plate portion 11*a* of the guide rail 11 to be inserted therein. As shown in FIG. 10, the guide rail 11 is prevented from moving in the thickness direction of the central plate portion 11*a* by fitting the lower end of the central plate portion 11*a* of the guide rail 11 into the fitting grooves 30*g* and being held between the bilaterally-positioned protrusion 30*e* and the fulcrum protrusions 30*d*. At this stage, a portion of the central plate portion 11*a* which is positioned above the fitting groove 11*d* is fitted into the fitting groove 30*h*, so that the guide rail 11 is also prevented from moving in the thickness direction of the central plate portion 11*a* by being held between the central retaining protrusion 30*c* and the angular protrusion 30*b* (see FIG. 3). In this fit-engaged state of the guide rail 11 in the fitting grooves 30*g* and 30*h*, the central retaining protrusion 30*c* and the central plate portion 11*a* are prevented from interfering with each other due to the presence of the fitting groove 11*d*.

The window regulator 10 that is structured as described above is assembled in a manner which will be discussed hereinafter. First, the slider base 12 is made to be supported onto the guide rail 11 to be slidable with respect to the guide rail 11, and the wire guide 13 is pivotally supported via the support shaft 25. One end of the first wire 17 and one end of the second wire 18 are connected to the drum 15 after the length of each wire is set to an appropriate tension in a completed state of the window regulator 10 that is shown in FIG. 1. In addition, the driver 16 is mounted to the drum housing 14. The bracket 20 and the bracket 21 are mounted to the guide rail 11 at an arbitrary timing.

Subsequently, the guide rail 11 and the drum housing 14 are joined together. This joining operation is performed via the stages shown in FIGS. 6 through 10. FIGS. 7 through 10 show side elevational views of the fitting portion 30; however, in regard to the guide rail 11, only the cross sectional shape of the central plate portion 11*a* is shown in these drawings.

Figure 7:
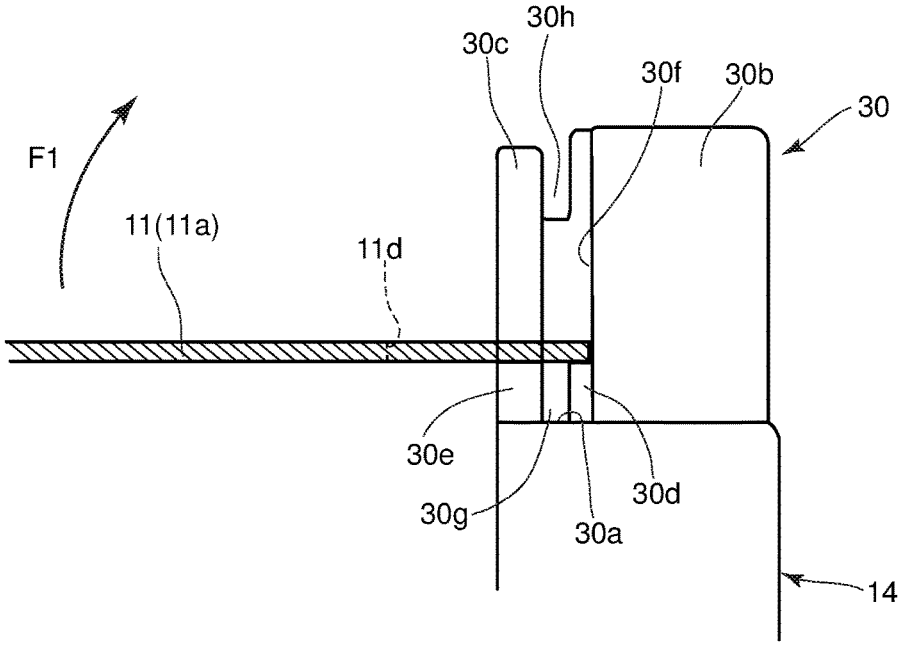
FIG. 7 is a side elevational view of the joined portion between the drum housing and the guide rail in the state shown in FIG. 6.
Figure 8:
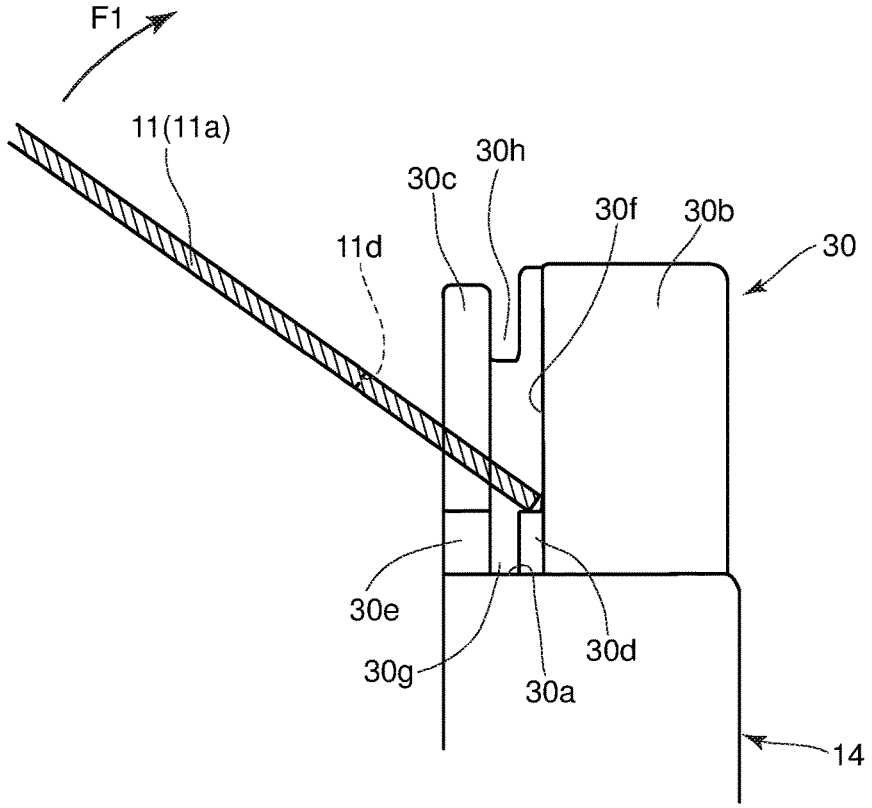
FIG. 8 is a side elevational view illustrating a state where the guide rail is in the process of being raised with respect to the drum housing from the state shown in FIG. 7.

First, as shown in FIGS. 6 and 7, the lower end of the guide rail 11 and the fitting portion 30 of the drum housing 14 are orientated to be substantially normal to each other (the guide rail 11 is orientated to extend horizontally) with respect to the positional relationship therebetween in a completed state of the window regulator 10, and the lower end surface of the guide rail 11 is brought into contact with the restriction surface 30*f* of the angular protrusion 30*b*, with portions of the central plate portion 11*a* which are positioned on both sides of the fitting groove 11*d* being respectively supported by the top surfaces of the fulcrum protrusions 30*d* and the bilaterally-positioned protrusions 30*e*. Thereupon, the central retaining protrusion 30*c* enters the fitting groove 11*d*. In this state, the ends of the first wires 17 and the second wires 18 which are not connected to the drum 15 are connected to the wire connecting portion 12*a* of the slider base 12. The first wire 17 is wound around the guide groove 13*a* of the wire guide 13. At this stage, the drum 15 and the slider base 12 to which the first wire 17 and the second wire 18 are connected do not lie on an extension of the guide rail 11 in the lengthwise direction thereof. Due to the positional relationship between the drum 15 and the slider base 12, the first wire 17 and the second wire 18 extend in a lateral direction of the drum housing 14 (in a direction toward the horizontally-extending guide rail 11) through the wire insertion slit 14*b* and the aforementioned wire insertion slit (not shown in the drawings), respectively, so that the routing of the first wire 17 and the second wire 18 becomes shorter than that in a completed state of the window regulator 10. This makes it possible to install the first wire 17 and the second wire 18 in a loosened state.

Subsequently, the guide rail 11 is raised in the direction shown by the arrow F1 shown in FIG. 7. This raising operation is performed with contact points between the lower end of the guide rail 11 and the fulcrum protrusions 30*d* serving as a fulcrum, and the guide rail 11 can be made to tilt without the fitting portion 30 interfering due to the central retaining protrusion 30*c* passing through the fitting groove 11*d*. As the raising angle of the guide rail 11 increases, as shown in the transition from the state shown in FIG. 7 to the state shown in FIG. 8, the relative positions between each of the slider base 12 and the wire guide 13 (which are supported on the guide rail 11 side) and the drum 15 (which is supported on the drum housing 14 side) varies, and in accordance with this variation in positional relationship, the first wire 17 and the second wire 18 are gradually tensioned. Namely, the operation to raise the guide rail 11 is performed while resisting against the wire tensile force.

Figure 9:
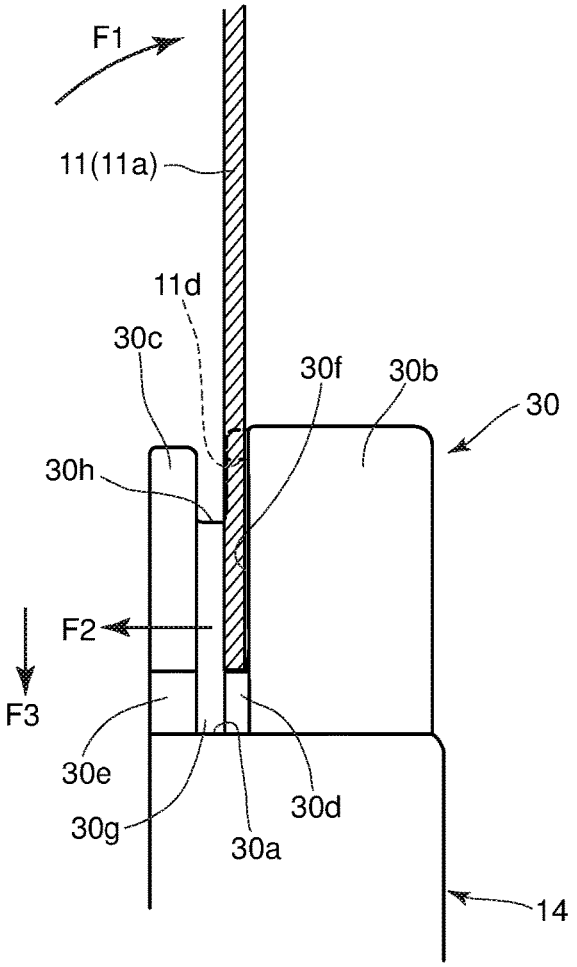
FIG. 9 is a side elevational view illustrating a stage at which the raising of the guide rail with respect to the drum housing has been completed.

The guide rail 11 is raised until the position shown in FIG. 9, at which the central plate portion 11*a* extends along the restriction surface 30*f* of the angular protrusion 30*b*. At this stage, the direction in which the first wire 17 and the second wire 18 are extended corresponds to the lengthwise direction of the guide rail 11. In this state, the lower end of the central plate portion 11*a* sits on top of the fulcrum protrusions 30*d*, and the distances between the wire guide 13 and the slider base 12 and between the wire guide 13 and the drum 15 have increased, so that the tensile force acting on the first wire 17 and the second wire 18 is great.

Sliding the guide rail 11 in a direction (F2) by which the central plate portion 11*a* moves away from the restriction surface 30*f* from the state shown in FIG. 9 causes the lower end of the central plate portion 11*a* to shift to an extended position from the fitting grooves 30*g* from a position overlaying the fulcrum protrusions 30*d*, thus causing the guide rail 11 which has been released from movement restrictions imposed by the fulcrum protrusions 30*d* to move in a direction (F3) to bring the lower end surface of the guide rail 11 into contact with the abutting surface 30*a*, as shown in FIG. 10. Since this movement is in a direction to reduce the tension of the first wire 17 and the second wire 18, no load is imposed during this operation. In addition, upon the lower end surface of the guide rail 11 abutting against the abutting surface 30*a*, as shown in FIG. 10, the relative position between the drum housing 14 and the guide rail 11 in the lengthwise direction of the guide rail 11 is determined by this abutment. Additionally, the guide rail 11 is prevented from moving relative to the drum housing 14 in the thickness direction of the guide rail 11 by the fitting of the central plate portion 11*a* of the guide rail 11 into the fitting grooves 30*g* and 30*h*, and is prevented from moving relative to the drum housing 14 in the widthwise direction of the guide rail 11 by the pair of side plate portions 11*b* abutting against both side surfaces of the angular protrusion 30*b*. The state shown in FIG. 10 corresponds to the completed state of the window regulator shown in FIG. 1, and an appropriate magnitude of tensile force acts on the first wire 17 and the second wire 18.

As described above, in the present embodiment of the window regulator 10, the first wire 17 and the second wire 18 are installed in a state (FIGS. 6 and 7) where the guide rail 11 is made to abut against the fitting portion 30 of the drum housing 14 in the lateral direction. In this state, the wire routing has been shortened, which makes it possible to install the first wire 17 and the second wire 18 easily in a loosened state. Subsequently, each wire 17 and 18 is brought into a tensioned state by an operation to raise the guide rail 11 with the fitting portion 30 (the fulcrum protrusions 30*d*) of the drum housing 34 as a fulcrum; in addition, the central plate portion 11*a* is fitted into the fitting grooves 30*g* and 30*h* to thereby complete the fitting of the guide rail 11 onto the drum housing 14. By performing the assembly by such a series of operations, load during installation of the wires is small; in addition, the guide rail 11 and the drum housing 14 can be easily fitted, and a superior workability can be achieved in the production of the window regulator 10.

In addition, by performing the operation to raise the guide rail 11 with the fulcrum protrusions 30*d* serving as a fulcrum, the fitting operation between the drum housing 14 and the guide rail 11 can be performed efficiently, and the guide rail 11 can be prevented from interfering with, and being deformed by, other portions of the fitting portion 30.

FIGS. 11 through 15 show a second embodiment of the joining structure and the joining process for the guide rail 11 and the drum housing 14 of the window regulator. This embodiment has the same structure as the previous embodiment except that the drum housing 14 is not provided on the fitting portion 30 thereof with the fulcrum protrusion 30*d*; common parts are designated by the same reference numerals as shown in FIGS. 1 through 10.

When assembling the window regulator, the installation of the slider base 12 and the wire guide 13 to the guide rail 11, and the connection of the first wire 17 and the second wire 18 to the drum 15 are to be performed at a stage before the guide rail 11 and the drum housing 14 are joined, in a similar manner as that of the previous embodiment.

Figure 12:
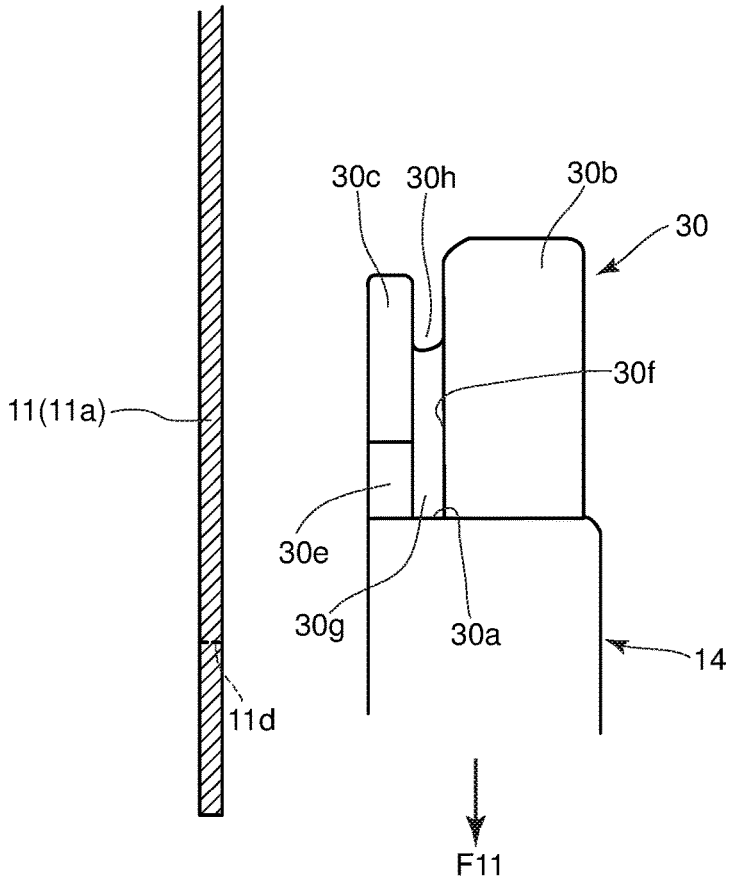
FIG. 12 is a side elevational view illustrating a process of assembling the drum housing and the guide rail in the second embodiment.

The connecting of the first wire 17 and the second wire 18 to the wire connecting portion 12*a* of the slider base 12 are performed with the guide rail 11 and the fitting portion 30 of the drum housing 14 being positioned to overlap each other in the lengthwise direction of the guide rail 11 as shown in FIG. 12. In this state, the routing of the first wire 17 and the second wire 18 is shorter than that in a completed state of the window regulator, which makes it possible to install the first wire 17 and the second wire 18 in a loosened state.

Subsequently, from the state shown in FIG. 12, the drum housing 14 is made to move against the tension of the first wire 17 and the second wire 18 toward the lower end surface of the guide rail 11 (in the direction shown by the arrow F11) along the lengthwise direction of the guide rail 11. This movement of the drum housing 14 is performed up to the position shown in FIG. 13, at which the lower end surface of the guide rail 11 is positioned beyond (above) the upper end surface of the central retaining protrusion 30*c* of the fitting portion 30.

Figure 13:
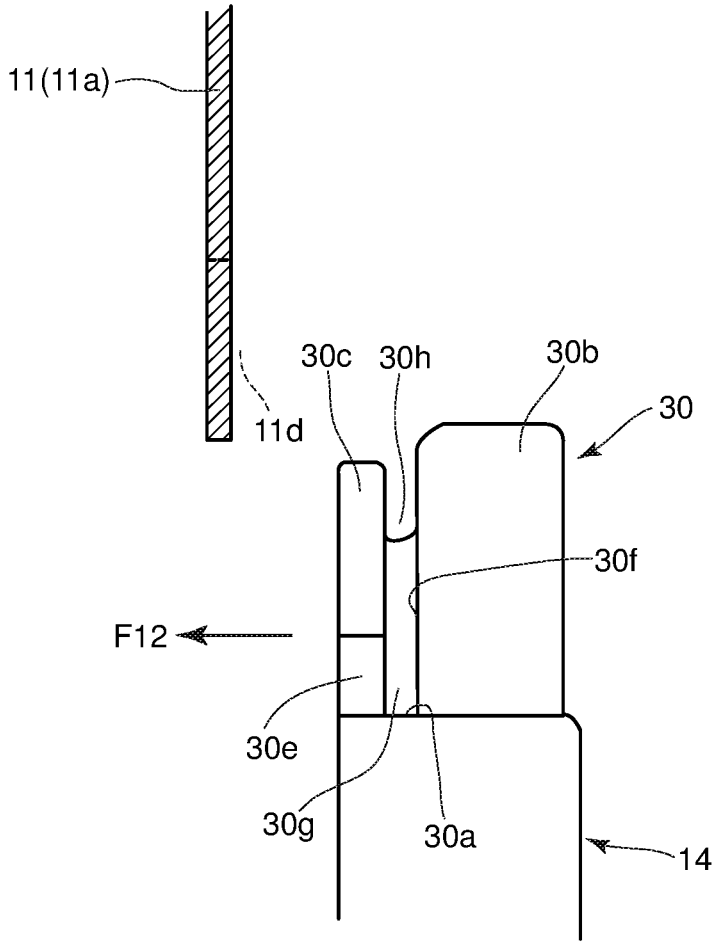
FIG. 13 is a side elevational view illustrating a process of assembling the drum housing and the guide rail in the second embodiment.
Figure 14:
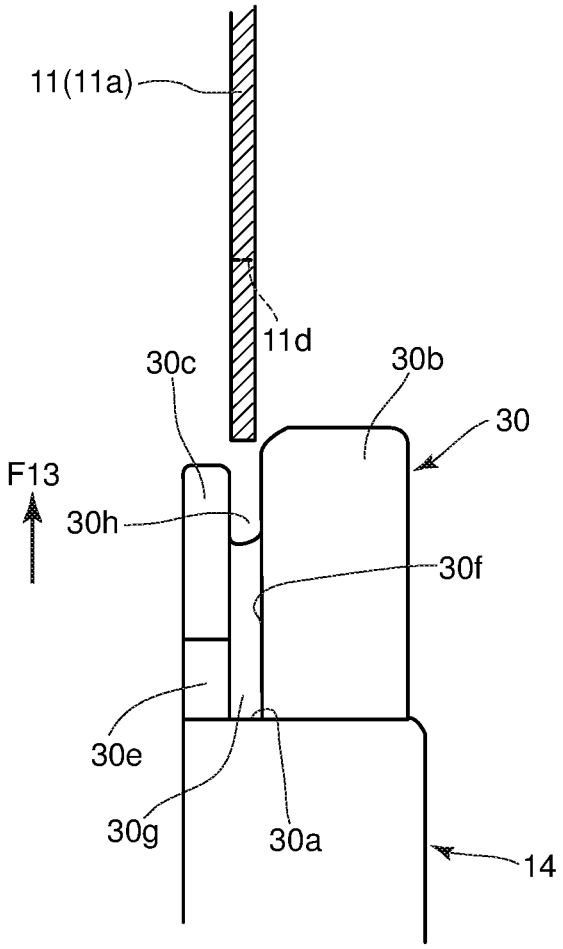
FIG. 14 is a side elevational view illustrating a process of assembling the drum housing and the guide rail in the second embodiment.

Upon reaching the position shown in FIG. 13, the drum housing 14 is made to move in the thickness direction of the guide rail 11 (F12) to cause the central plate portion 11*a* of the guide rail 11 to be positioned on extensions of the fitting grooves 30*g* and 30*h*, as shown in FIG. 14. At this stage, upon the application of a force in the direction against the tension of the first wire 17 and the second wire 18 being released, the drum housing 14 moves in a direction (F13), by which the abutting surface 30*a* of the fitting portion 30 comes into contact with the lower end surface of the guide rail 11.

Figure 15:
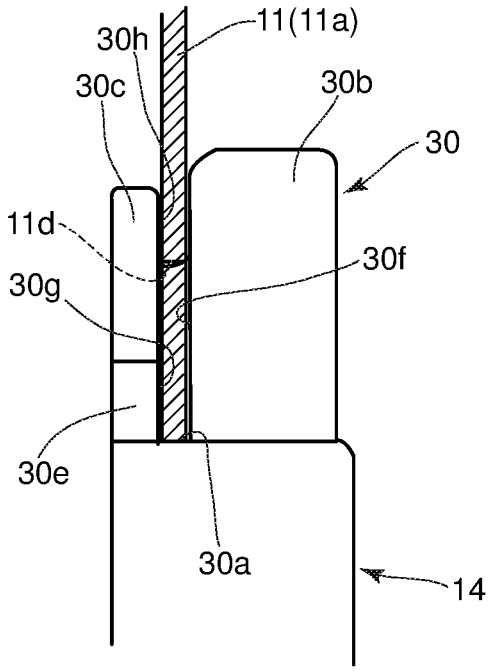
FIG. 15 is a side elevational view illustrating a state where the fitting between the guide rail and the drum housing has been completed in the second embodiment.

As a result, the lower end of the central plate portion 11*a* is fitted into the fitting grooves 30*g* (while being held between the restriction surface 30*f* of the angular protrusion 30*b* and the bilaterally-positioned protrusions 30*e*), as shown in FIG. 15, and a portion of the central plate portion 11*a* which faces the upper edge of the engaging groove 11*d* enters the fitting groove 30*h*, thereby completing the fitting operation between the guide rail 11 and the drum housing 14. In other words, the end of the guide rail 11 rides over the bilaterally-positioned protrusions (second protrusions) 30*e* to fit into the fitting grooves 30*g* and 30*h*. In the state shown in FIG. 15, the position of the guide rail 11 in the lengthwise direction thereof is determined by the engagement between the lower end surface of the guide rail 11 and the abutting surface 30*a*, and an appropriate magnitude of tensile force acts on the first wire 17 and on the second wire 18. Additionally, the guide rail 11 is prevented from moving relative to the drum housing 14 in the thickness direction of the guide rail 11 by the fitting of the central plate portion 11*a* in the fitting grooves 30*g* and 30*h*, and is prevented from moving relative to the drum housing 14 in the widthwise direction of the guide rail 11 by the abutting of the pair of side plate portions 11*b* on both side surfaces of the angular protrusion 30*b*.

In the above second embodiment also, by moving the guide rail 11 and the drum housing 14 relative to each other in the lengthwise direction of the guide rail 11 against the wire tension after the first wire 17 and the second wire 18 are loosened and installed in a state where the guide rail 11 and the drum housing 14 are not joined, and further by fitting the central plate portion 11*a* into the fitting grooves 30*g* and 30*h*, load during installation of the wires is small; in addition, the guide rail 11 and the drum housing 14 can be easily fitted, which improves the workability during manufacturing of the window regulator. Although the operation to join the drum housing 14 and the guide rail 11 has been discussed above as an operation to join the drum housing 14 to the guide rail 11 by moving the drum housing 14 relative to the guide rail 11, the guide rail 11 can be moved with reference to the drum housing 14.

In the second embodiment, the wire insertion slit 14*b* can be modified to be open only at the upper side (the abutting surface 30*a*) of the drum housing 14 because the guide rail 11 and the drum housing 14 can be moved relative to each other in the lengthwise direction of the guide rail 11 without any variation in angle of the guide rail 11, as in the first embodiment when an end of the guide rail 11 is fitted onto the fitting portion 30 of the drum housing 14. However, the wire insertion slit 14*b* in the above illustrated embodiment, which is open also to a side surface of the drum housing 14, is superior in workability during installation.

Although the present invention has been described based on the above illustrated embodiments, the present invention is not limited solely thereto; improvements and modifications to the above illustrated embodiments are possible without departing the gist of the present invention.

INDUSTRIAL APPLICABILITY

As detailed above, according to the present invention, the fitting portion of the drum housing is provided with the first protrusion and the second protrusion, which are mutually different in amount of protrusion from the abutting surface of the drum housing, and the guide rail is fitted onto the drum housing in a state where movement of the guide rail in the thickness direction thereof is restricted by inserting the guide rail in between the first protrusion and the second protrusion; this facilitates the assembling operation for the drum housing and the guide rail, thus making it possible to improve the productivity of the window regulator.

REFERENCE SIGN LIST

10 Window regulator
11 Guide rail
11*a* Central plate portion
11*b* Side plate portion
11*c* Flange
11*d* Fitting groove
12 Slider base
12*a* Wire connecting portion
13 Wire guide
13*a* Guide groove
14 Drum housing
14*a* Recessed portion
14*b* Wire insertion slit
15 Drum
15*a* Wire winding groove
15*b* Rotation transmission hole
16 Driver
16*a* Drive shaft
17 First wire
18 Second wire
20 21 Bracket
22 Motor
23 Set screw
25 Support shaft
30 Fitting portion
30*a* Abutting surface
30*b* Angular protrusion (First protrusion)
30*c* Central retaining protrusion (Central protrusion)
30*d* Fulcrum protrusion (First protrusion/Stepped portion)
30*e* Bilaterally-positioned protrusions (Second protrusions)
30*f* Restriction surface
30*g* 30*h* Fitting groove

The invention claimed is:

1. A method of producing a window regulator for raising and lowering a window glass of a vehicle, said window regulator including a guide rail which extends in raising and lowering directions of said window glass, a slider base which supports said window glass and is slidably supported relative to said guide rail in a lengthwise direction thereof, a drum housing which supports a drum in a manner to allow said drum to rotate and includes an abutting surface with which an end surface of said guide rail is in contact, and a wire which connects said drum and said slider base and moves said slider base along said guide rail in accordance with rotation of said drum, wherein said method comprises:

providing said drum housing, on said abutting surface thereof, with a fitting portion which includes a first protrusion and a second protrusion, said second protrusion protruding from said abutting surface by a smaller amount than that of said first protrusion and facing said first protrusion while being spaced from said first protrusion in a thickness direction of said guide rail;

connecting said wire to said slider base and said drum which are respectively supported by said guide rail and said drum housing in a state where said wire is loosened and in a state where said guide rail and said fitting portion of said drum housing are not engaged with each other;

moving said guide rail and said drum housing relative to each other in a direction to increase tension of said wire along said lengthwise direction of said guide rail;

moving said guide rail and said drum housing relative to each other in said thickness direction of said guide rail to allow an end of said guide rail ride over said second protrusion; and inserting said guide rail in between said first protrusion and said second protrusion to restrict movement of said guide rail in said thickness direction of said guide rail in a state where said wire is tensioned.

2. The method of producing said window regulator according to claim 1, wherein a pair of said second protrusions are spaced from each other in a widthwise direction of said guide rail, wherein said fitting portion comprises a central protrusion which is positioned between said pair of second protrusions, said central protrusion protruding from said abutting surface by a greater amount than that of said pair of second protrusions, and wherein said guide rail includes a fitting groove which is fitted on said central protrusion.

3. The method of producing said window regulator according to claim 1, wherein a lower end surface of said drum housing abuts against said abutting surface of said drum housing.

4. A method of producing a window regulator for raising and lowering a window glass of a vehicle, said window regulator including a guide rail which extends in raising and lowering directions of said window glass, a slider base which supports said window glass and is slidably supported relative to said guide rail in a lengthwise direction thereof, a drum housing which supports a drum in a manner to allow said drum to rotate and includes an abutting surface with which an end surface of said guide rail is in contact, and a wire which connects said drum and said slider base and moves said slider base along said guide rail in accordance with rotation of said drum, wherein said method comprises:

providing said drum housing, on said abutting surface thereof, with a fitting portion which includes a first protrusion and a second protrusion, said second protrusion protruding from said abutting surface by a smaller amount than that of said first protrusion and facing said first protrusion while being spaced from said first protrusion in a thickness direction of said guide rail;

connecting said wire to said slider base and said drum which are respectively supported by said guide rail and said drum housing in a state where said wire is loosened and in a state where said guide rail and said fitting portion of said drum housing are not engaged with each other;

abutting said end surface of said guide rail against said fitting portion of said drum housing in a different orientation from an orientation in a completed state of said window regulator, and increasing tension of said wire while changing an angle of said guide rail with the abutting portion, on which said end surface of said guide rail abuts against said fitting portion, as a fulcrum; and positioning said guide rail between said first protrusion and said second protrusion to restrict movement of said guide rail in said thickness direction of said guide rail in a state where said wire is tensioned.

5. The method of producing said window regulator according to claim 4, wherein said first protrusion comprises:

a body portion which protrudes from said abutting surface by a greater amount than that of said second protrusion; and a stepped portion which is positioned between said body portion and said second protrusion, said stepped portion protruding from said abutting surface by a smaller amount than that of said body portion, wherein said end surface of said guide rail abuts against said stepped portion, and said angle of said guide rail is changed, with said abutting portion as a fulcrum.

6. A window regulator for raising and lowering a window glass of a vehicle, comprising:

a guide rail which extends in raising and lowering directions of said window glass;

a slider base configured to support said window glass and is supported by said guide rail to slide relative to said guide rail in a lengthwise direction thereof;

a drum housing configured to support a drum in a manner to allow said drum to rotate, said drum housing including a fitting portion that is fitted to one end of said guide rail;

a wire guide which is supported by another end of said guide rail; and a wire which is guided by said wire guide and connects said drum with said slider base, said wire moving said slider base along said guide rail in accordance with a rotation of said drum, wherein said fitting portion of said drum housing includes:

a first protrusion configured to protrude from an abutting surface with which an end surface of said guide rail is in contact;

a pair of second protrusions which protrude from said abutting surface, protrude from said abutting surface by a smaller amount than that of said first protrusion, restrict movement of said guide rail in a thickness direction thereof by inserting said guide rail in between said first protrusion and said pair of second protrusions, and are provided spaced from each other in a widthwise direction of said guide rail; and a central protrusion which is formed integral with said first protrusion, is positioned between said pair of second protrusions and greater in amount of protrusion from said abutting surface than said pair of second protrusions, and wherein said guide rail includes a fitting groove which is fitted on said central protrusion.

7. The window regulator according to claim 6, wherein said first protrusion comprises:

a body portion which protrudes from said abutting surface by a greater amount than that of said second protrusion; and a stepped portion which is positioned between said body portion and said second protrusion, said stepped portion protruding from said abutting surface by a smaller amount than that of said body portion.

8. The window regulator according to claim 6, wherein said drum housing comprises a wire insertion slit which allows said wire to be inserted thereinto, and a slit portion which is formed on a side surface adjacent to said abutting surface to be continuous with said wire insertion slit.

9. The window regulator according to claim 6, wherein said central protrusion is smaller in width than said first protrusion.

* * * * *